US007489326B2

(12) United States Patent
Park

(10) Patent No.: US 7,489,326 B2
(45) Date of Patent: Feb. 10, 2009

(54) METHOD AND APPARATUS FOR DRIVING LIQUID CRYSTAL DISPLAY PANEL

(75) Inventor: Joon Ha Park, Taegu-shi (KR)

(73) Assignee: LG Display Co., Ltd., Seoul (KR)

( * ) Notice: Subject to any disclaimer, the term of this patent is extended or adjusted under 35 U.S.C. 154(b) by 384 days.

(21) Appl. No.: 11/280,227

(22) Filed: Nov. 17, 2005

(65) Prior Publication Data

US 2006/0077159 A1 Apr. 13, 2006

(51) Int. Cl.
*G09G 5/02* (2006.01)

(52) U.S. Cl. ..... 345/696; 345/694

(58) Field of Classification Search ..... 345/88, 345/613, 694–696; 382/299; 349/43
See application file for complete search history.

(56) References Cited

U.S. PATENT DOCUMENTS

| | | | |
|---|---|---|---|
| 5,124,695 | A | 6/1992 | Green |
| 5,126,865 | A | 6/1992 | Sarma |
| 5,648,793 | A | 7/1997 | Chen |
| 5,963,190 | A | 10/1999 | Tsuboyama et al. |
| 6,144,352 | A | 11/2000 | Matsuda et al. |
| 6,326,981 | B1 | 12/2001 | Mori et al. |
| 6,340,998 | B1 | 1/2002 | Kim et al. |
| 6,469,756 | B1 | 10/2002 | Booth, Jr. |
| 6,661,429 | B1 | 12/2003 | Phan |
| 2002/0015110 | A1 | 2/2002 | Elliott et al. |
| 2003/0034992 | A1 | 2/2003 | Brown Elliott |

FOREIGN PATENT DOCUMENTS

DE 197 16 095 11/1997

OTHER PUBLICATIONS

Elliott, Candice Hellen Brown, "Reducing Pixel Count without Reducing Image Quality," pp. 22-25, (Dec. 1999).

*Primary Examiner*—Ricardo L Osorio
(74) *Attorney, Agent, or Firm*—McKenna Long & Aldridge, LLP

(57) ABSTRACT

A method and apparatus for driving a liquid crystal display panel that is capable of driving a liquid crystal display panel having five color dots within one pixel. In the method, adjacent first color sub-pixels spaced at a desired distance, of a plurality of first color sub-pixels arranged at the middle portion of a pixel are shorted to apply a first color data to said adjacent first color sub-pixels. A second color data is applied to a plurality of second color sub-pixels arranged at one edge of said middle portion within said one pixel. A third color data is applied to a plurality of third color sub-pixels arranged at other edge of said middle portion within said one pixel.

1 Claim, 13 Drawing Sheets

FIG. 4A
CONVENTIONAL ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 4B
CONVENTIONAL ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

METHOD AND APPARATUS FOR DRIVING LIQUID CRYSTAL DISPLAY PANEL

This application claims the benefit of U.S. patent application Ser. No. 10/207,064, filed on Jul. 30, 2002, which claims priority to Korean Patent Application Nos. P2001-46933, filed on Aug. 3, 2001 and P2002-35150, filed on Jun. 22, 2002.

BACKGROUND OF THE INVENTION

1. Field of the Invention

The present invention relates to liquid crystal display, and more particularly, to a method and apparatus for driving a liquid crystal display panel that is capable of driving a liquid crystal display panel having five color dots within one pixel as well as reducing flicker.

2. Discussion of the Related Art

Generally, a liquid crystal display (LCD) controls a light transmittance of each liquid crystal cell in accordance with a video signal to thereby display a picture. An active matrix LCD including a switching device for each liquid crystal cell is suitable for displaying a dynamic image. The active matrix LCD uses thin film transistors (TFT's) as switching devices.

FIG. 1 is a block diagram of a typical liquid crystal display driving apparatus.

Referring to FIG. 1, the LCD driving apparatus includes a digital video card 1 for converting analog video data into digital video data, a data driver 3 for applying the digital video data to data lines DL of a liquid crystal display panel 6, a gate driver 5 for sequentially driving gate lines GL of the liquid crystal display panel 6, and a timing controller 2 for controlling the data driver 3 and the gate driver 5.

The liquid crystal display panel 6 has a liquid crystal injected between two glass substrates, on which the gate lines GL and the data lines DL cross each other perpendicularly. Each intersection between the gate lines GL and the data lines DL is provided with a thin film transistor (TFT) for selectively applying an image inputted from each data line DL to a liquid crystal cell Clc. To this end, the TFT has a gate terminal connected to the gate line GL, a source terminal connected to the data line DL and a drain terminal connected to a pixel electrode of the liquid crystal cell Clc.

The digital video card 1 converts an input analog image signal into a digital image signal suitable for the liquid crystal display panel 6, and detects a synchronizing signal included in the image signal.

The timing controller 2 supplies red(R), green(G) and blue (B) digital video data from the digital video card 1 to the data driver 3. Further, the timing controller 2 generates data and gate control signals such as a dot clock Dclk and a gate start pulse Gsp using horizontal and vertical synchronizing signals H and V inputted from the digital video card 1 to make a timing control of the data driver 3 and the gate driver 5. The data control signal such as a dot clock Dclk is applied to the data driver while the gate control signal such as a gate start pulse Gsp is applied to the gate driver.

The gate driver 5 includes a shift register (not shown) for sequentially applying a scanning pulse in response to the gate start pulse Gsp from the timing controller 2, and a level shifter. (not shown) for shifting a voltage level of the scanning pulse into a level suitable for driving the liquid crystal cell Clc. The TFT applies a video data on the data line DL to the pixel electrode of the liquid crystal cell Clc in response to the scanning pulse from the gate driver 5.

The data driver 3 receives R, G and B digital video data along with a dot clock Dclk from the timing controller 2. The data driver 3 latches the R, G and B video data in synchronization with the dot clock Dclk and then corrects the latched data in accordance with a gamma voltage Vγ. Furthermore, the data driver 3 converts data corrected by the gamma voltage Vγ into analog data to apply them to the data line DL one line by one line.

FIG. 2 represents a relationship between a pixel and a TFT structure of the LCD shown in FIG. 1.

Referring to FIG. 2, the pixel of the LCD consists of an area defined by four data lines DL1 to DL4 and two gate lines GL1 and GL2. A pixel electrode 12*a* is provided at an area surrounded by the gate lines GL1 and GL2 and the data lines DL1 and DL2, forming one pixel. A pixel electrode 12*b* is provided at an area surrounded by the gate lines GL1 and GL2 and the data lines DL2 and DL3. A pixel electrode 12*c* is provided at an area surrounded by the gate lines GL1 and GL2 and the data lines DL3 and DL4 which makes one pixel. One picture element 16 consists of these three pixels, and a side of each pixel electrode 12 is provided with a TFT 14 which is a switching device.

Typically, color filters R, G and B are provided at the substrate opposite the transparent substrate with the pixel electrode. In this case, an R color filter is arranged at a position corresponding to the left pixel electrode 12*a* of one picture element shown in FIG. 2; a G color filter is arranged at a position corresponding to the middle pixel electrode 12*b*; and a B color filter is arranged at a position corresponding to the right pixel electrode 12*c*.

For a VGA resolution display, 640 data lines DL and 480 gate lines GL are provided resulting in 307200 picture elements.

FIG. 3 shows an arrangement of the R, G and B color filters and a connection between the gate driver 5 and the data driver 3 in the conventional LCD of FIG. 1. Referring to FIG. 3, the data driver 3 receives input signals Re (Red even), Ge (Green even), Be (Blue even), Ro (Red odd), Go (Green odd) and Bo (Blue odd) of a six-bus system and outputs them to the 1st to nth data lines DL1 to DLn in synchronization with a data clock.

The R signal is output to the first data line DL1 via the data driver 3; the G signal is output to the second data line DL2 via the data driver 3; and the B signal is output to the third data line DL3 via the data driver 3. The three output signals make a pair repetitively. At this time, depending on a line arrangement through the data driver 3, the B signal is output to the first data line DL1 via the data driver 3; the G signal is output to the second data line Dl2 via the data driver 3; and the R signal is output to the third data line DL3 via the data driver 3.

The LCD adopts a dot inversion driving system as shown in FIG. 4A and FIG. 4B. In the dot inversion system as shown in FIG. 4A and FIG. 4B, data signals of opposite polarities are applied to liquid crystal cells adjacent to each other for each column line and each row line on the liquid crystal display panel. The polarities of data signals applied to all liquid crystal cells of the liquid crystal display panel are inverted every frame. In other words, when video signals at a certain frame is displayed, data signals are applied to the liquid crystal cells of the liquid crystal display panel such that they have alternating positive polarity (+) and negative polarity (−) as the liquid crystal cells go from the left side to the right side in a row and from the top to the bottom in a column, as shown in FIG. 4A. Subsequently, for the next frame, the polarity of the data signals applied to the liquid crystal cells are inverted to be opposite to the polarity in the previous frame, as shown in FIG. 4B.

The conventional method of driving the liquid crystal display panel having such stripe-type pixels has a limit in improving picture quality, and has a problem in that it causes a flicker phenomenon upon driving the liquid crystal display panel by the dot inversion system.

SUMMARY OF THE INVENTION

Accordingly, the present invention is directed to a method and apparatus for driving a liquid crystal display panel that is capable of driving a liquid crystal display panel having five color dots within one pixel that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display panel according to one aspect of the present invention includes shorting adjacent first color sub-pixels spaced at a desired distance of a plurality of first color sub-pixels arranged at a middle portion of a pixel to apply a first color data to said adjacent first color sub-pixels; applying a second color data to a plurality of second color sub-pixels arranged at one edge of said middle portion within said one pixel; and applying a third color data to a plurality of third color sub-pixels arranged at another edge of said middle portion within said one pixel. Applying the second color data includes applying data to the second color sub-pixels arranged correspondingly in a diagonal direction around a first color sub-field within said one pixel. Applying the third color data includes applying data to the third color sub-pixels arranged correspondingly in a diagonal direction around a first color sub-field within said one pixel.

The method further includes allowing said second color sub-pixels arranged correspondingly in said diagonal direction to respond to a data signal having a polarity opposite to each other.

The method further includes allowing said third color sub-pixels arranged correspondingly in said diagonal direction to respond to a data signal having a polarity opposite to each other.

The method further includes allowing a plurality of first color sub-pixels arranged at the middle portion of said pixel to respond to a data signal having a polarity opposite to each other at a desired interval.

A driving apparatus for a liquid crystal display panel according to another aspect of the present invention includes signal selecting means for selecting sub-pixels to input red, green and blue data; control signal generating means for generating a control signal for controlling the signal selecting means using a horizontal synchronizing signal and an externally applied dot clock; wherein data output from the signal selecting means is applied to said sub-pixels to thereby display a picture.

In the driving apparatus, the signal selecting means includes first signal selecting means for allowing said red and green data to be alternately applied by said control signal upon driving of the liquid crystal display panel; and second signal selecting means for allowing said blue data to be applied every desired constant interval.

The control signal generating means includes first control signal generating means for supplying a control signal for allowing said green data to be applied every desired constant interval using said dot clock; and second control signal generating means for allowing said control signal to be applied to the signal selecting means and the first control signal generating means using said horizontal synchronizing signal.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings:

FIGS. 4A and 4B depict a conventional dot inversion driving system;

DETAILED DESCRIPTION OF THE ILLUSTRATED EMBODIMENTS

Reference will now be made in detail to an embodiment of the present invention, example of which is illustrated in the accompanying drawings.

Figure 1:
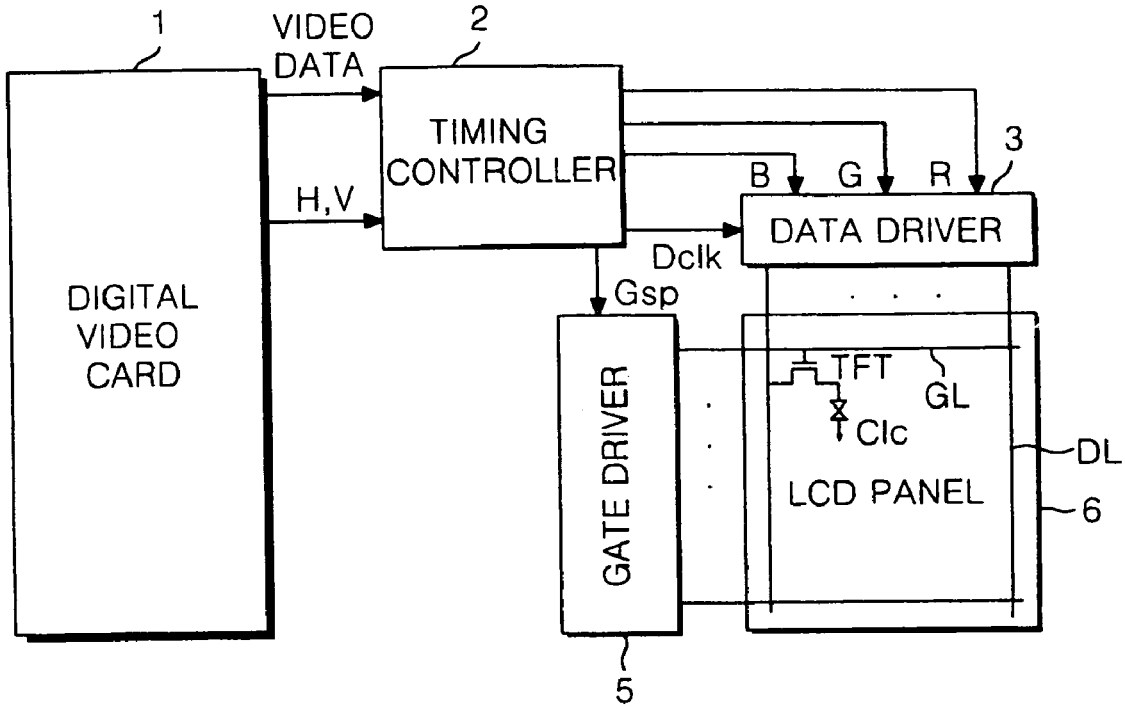
FIG. 1 CONVENTIONAL ART
FIG. 1 is a block diagram showing a conventional liquid crystal display driving apparatus.
Figure 2:
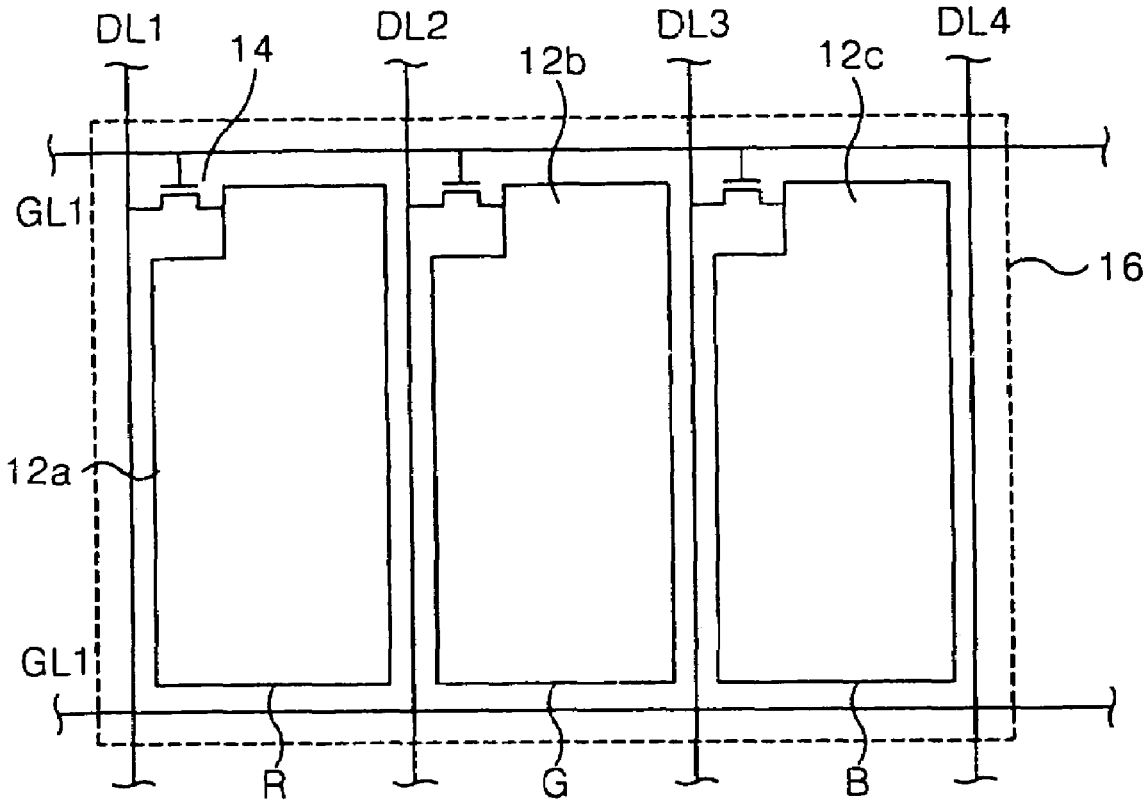
FIG. 2 CONVENTIONAL ART
FIG. 2 illustrates a relationship between a pixel and a TFT structure of the liquid crystal display shown in FIG. 2.
Figure 3:
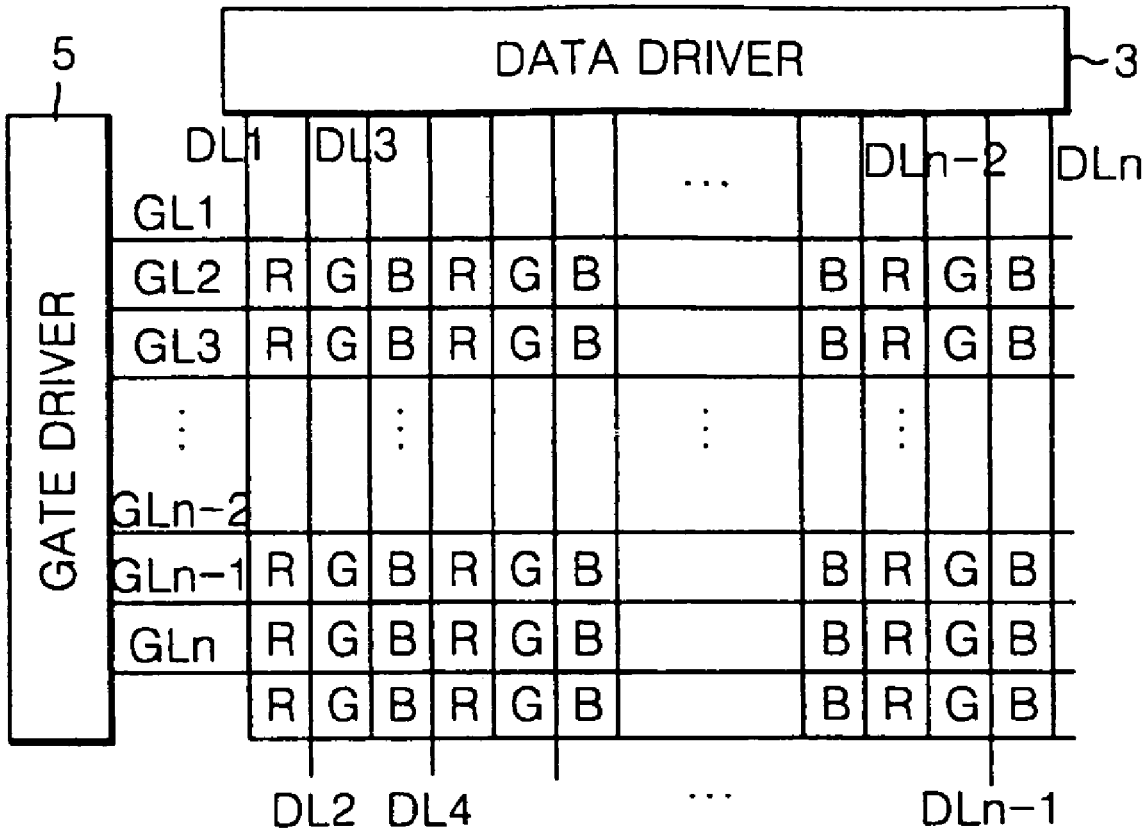
FIG.3 CONVENTIONAL ART
FIG. 3 shows an arrangement of the R, G and B color filters and a connection between the gate driver and the data driver in the conventional LCD of FIG. 1.
Figure 5:
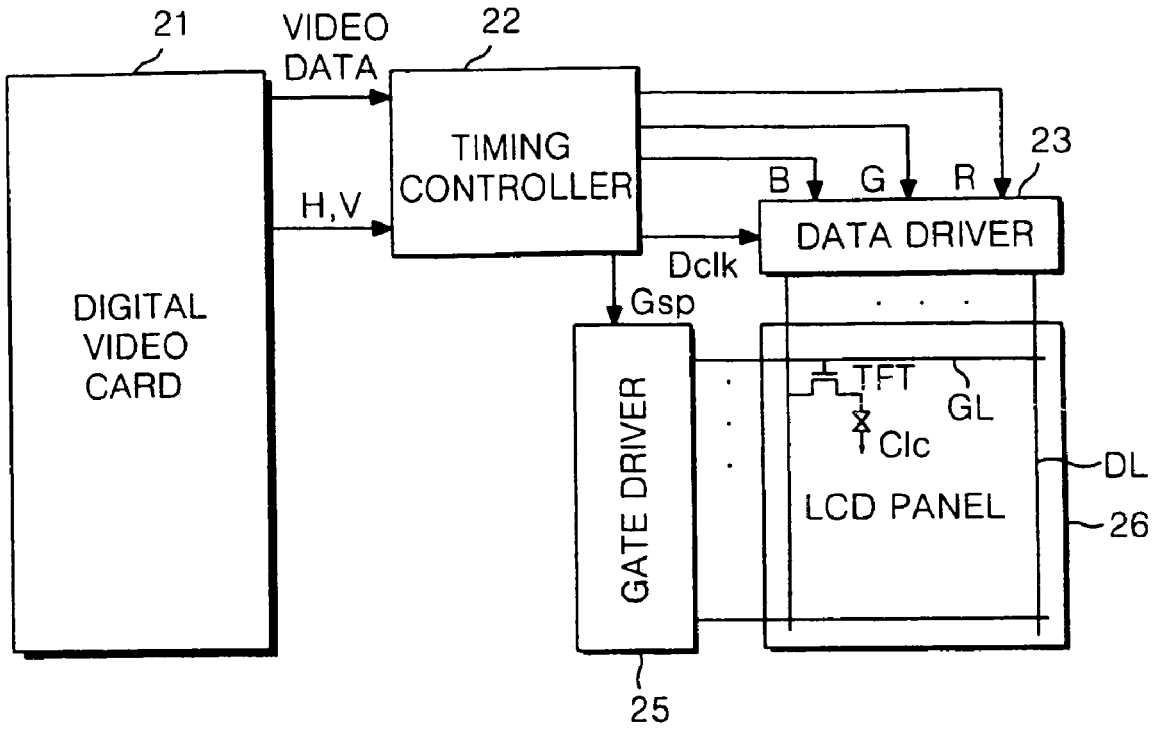
FIG. 5 is a block diagram showing a configuration of a liquid crystal display driving apparatus according to an embodiment of the present invention.

Referring to FIG. 5, there is shown a driving apparatus for a liquid crystal display (LCD) according to an embodiment of the present invention.

The LCD driving apparatus includes a digital video card 21 for converting analog video data into digital video data, a data driver 23 for applying the digital video data to data lines DL of a liquid crystal display panel 26, a gate driver 25 for sequentially driving gate lines GL of the liquid crystal display panel 26, and a timing controller 22 for controlling the data driver 23 and the gate driver 25.

The liquid crystal display panel 26 has liquid crystal between two glass substrates. The gate lines GL and the data lines DL cross each other perpendicularly. At each intersection between the gate lines GL and the data lines DL, a thin film transistor (TFT) is formed for selectively applying an image signal from each data line DL to a liquid crystal cell Clc. To this end, the TFT has a gate terminal connected to the gate line GL, a source terminal connected to the data line DL and a drain terminal connected to a pixel electrode of the liquid crystal cell Clc.

The digital video card 21 converts an input analog image signal into a digital image signal suitable for the liquid crystal display panel 26, and detects a synchronizing signal included in the image signal.

The timing controller 22 supplies red(R), green(G) and blue(B) digital video data from the digital video card 21 to the data driver 23. Further, the timing controller 22 generates data and gate control signals such as a dot clock Dclk and a gate start pulse Gsp, using horizontal and vertical synchronizing signals H and V input from the digital video card 21 for timing control of the data driver 23 and the gate driver 25. The dot clock Dclk is applied to the data driver 23 while the gate start pulse Gsp is applied to the gate driver 25.

The gate driver 25 includes a shift register (not shown) for sequentially applying a scanning pulse in response to the gate start pulse Gsp from the timing controller 22, and a level shifter (not shown) for shifting a voltage level of the scanning pulse into a level suitable for driving the liquid crystal cell Clc. The TFT applies a video data signal from the data line DL to the pixel electrode of the liquid crystal cell Clc in response to the scanning pulse from the gate driver 25.

The data driver 23 receives R, G and B digital video data along with a dot clock Dclk from the timing controller 22. The data driver 23 latches the R, G and B video data in synchronization with the dot clock Dclk and then corrects the latched data in accordance with a gamma voltage Vγ. Furthermore, the data driver 23 converts data corrected by the gamma voltage Vγ to analog data to apply them to the data line DL one line by one line.

Figure 6A:
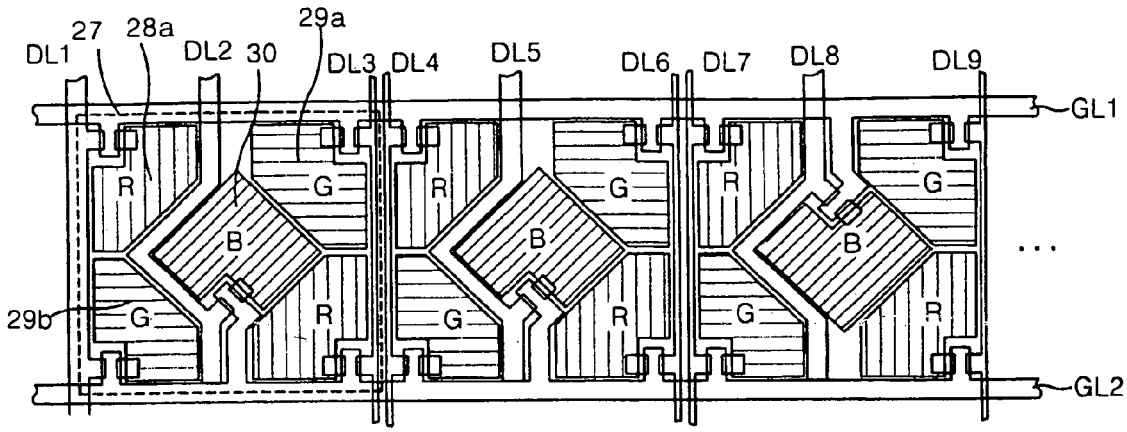
FIG. 6A and FIG. 6B are views for showing pixel structures of liquid crystal display panels according to first and second embodiments of the present invention and explaining a data input into the pixels.
Figure 6B:
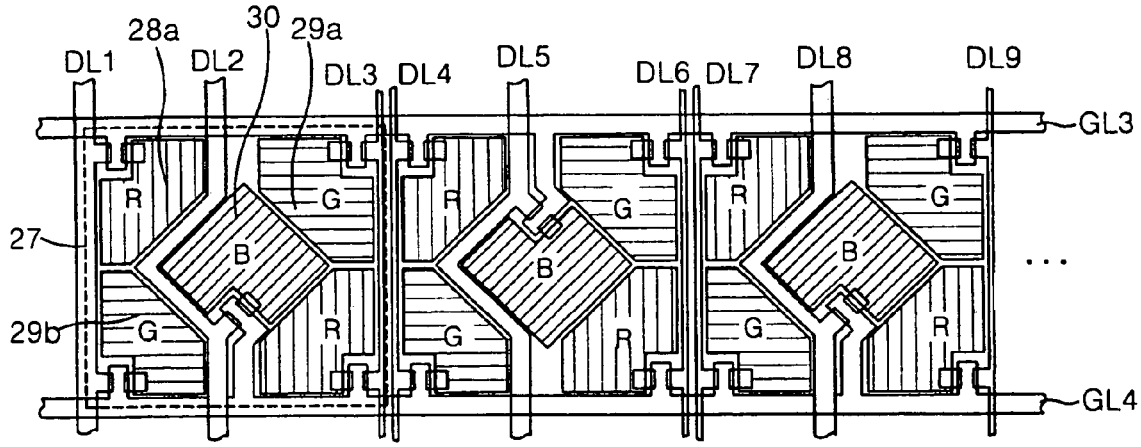

FIG. 6A and FIG. 6B show pixel structures of liquid crystal display panels according to first and second embodiments of the present invention and illustrate data input into the pixels.

Referring to FIG. 6A and FIG. 6B, one pixel of the liquid crystal display panel includes five different color dots. A pixel 27 has a regular square shape. The pixel 27 includes a dot or subpixel 30 having a lozenge-shaped B color filter such as to be in internal contact with the square-shaped pixel, dots 28*a* and 28*b* having R color filters at the upper left edge and the lower right edge of the pixel, and dots 29*a* and 29*b* having G color filters at the upper right edge and the lower left edge of the pixel.

FIG. 6A illustrates a structure in which the B dot 30 among the five dots is positioned between two data lines such as to be alternately connected to the lower data line DL and the upper data line DL every two pixels. FIG. 6B illustrates a structure in which the B dot 30 is positioned between two data lines such as to be alternately connected to the lower data line DL and the upper data line DL every one pixel. Accordingly, the B dot 30 displays a color only at two pixels on the basis of four pixels.

In the driving method for the liquid crystal display panel having five color dots in a single pixel, alternately post-inputs an R data signal and a G data to an R data bus and a G data bus for each gate line GL unlike the prior art in which a data enable signal is periodically applied for the R, G and B data signals.

In order to provide such a driving method, a new and different liquid crystal display panel driving method is need as well as a new system for the data driver.

Figure 7A:
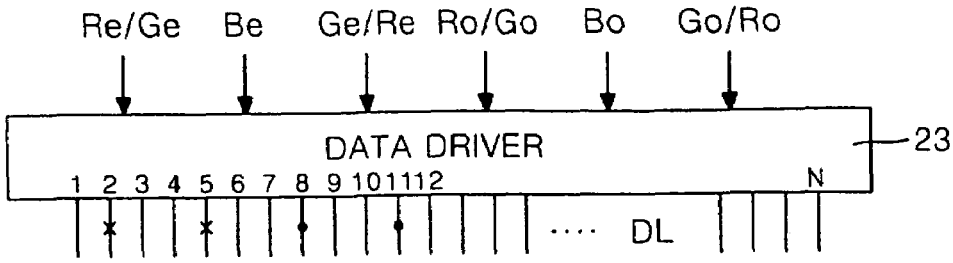
FIG. 7A and FIG. 7B illustrates the connection state of the data driver for driving the liquid crystal display panel having the pixel structure and the wiring shown in FIG. 6A.
Figure 7B:
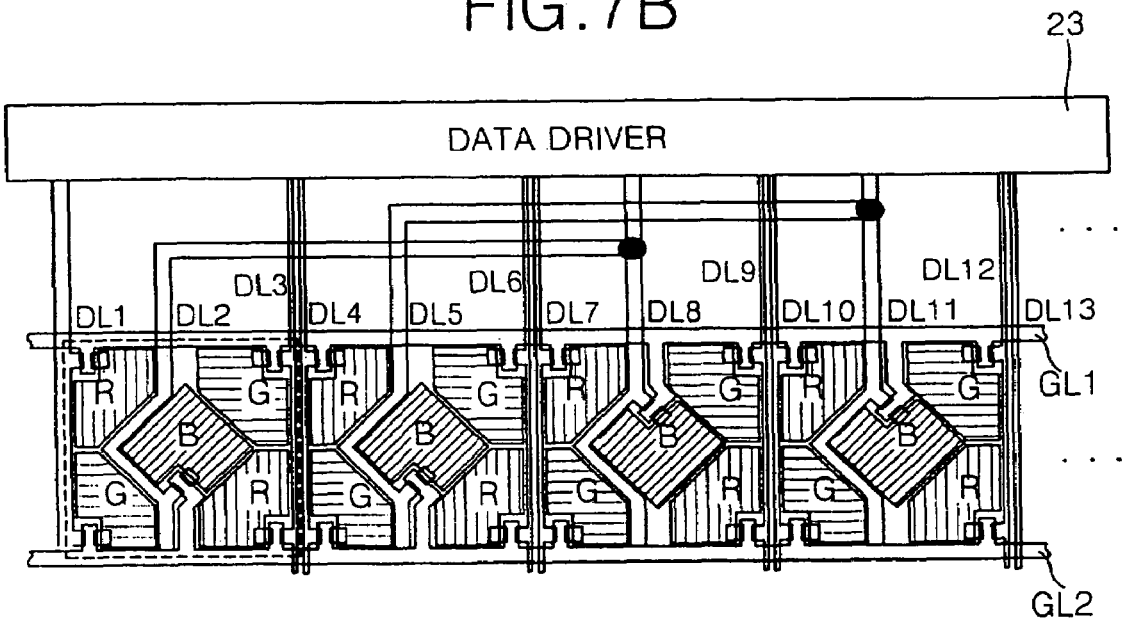

FIG. 7A and FIG. 7B illustrate a connection state of the data driver for driving the liquid crystal display panel having the pixel structure and the wiring shown in FIG. 6A. Referring to FIG. 7A and FIG. 7B, the LCD receives input signals Re, Ge, Be, Ro, Go and Bo of a six-bus data system to output them to the 1st to nth data lines DL1 to DLn in synchronization with the data clock.

In this embodiment, the 2nd and 5th output terminals of each of the 12 output terminals of the data driver 23 are broken or severed from the data lines DL. The 8th and 11th output terminals of the next-stage data driver 23 are normally connected to the data lines DL to output a B dot data. This connection manner is applied until the nth output terminal.

Figure 8:
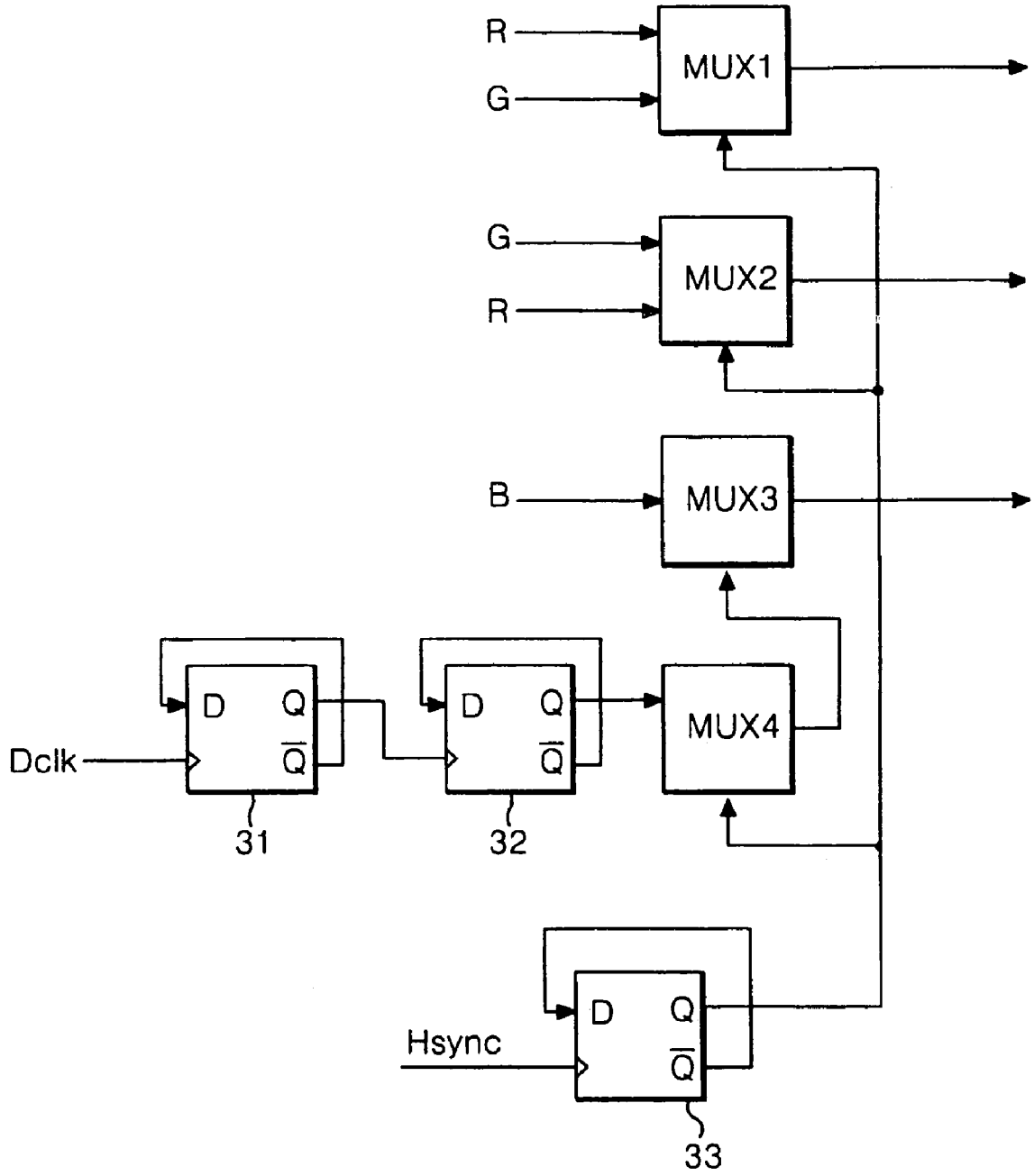
FIG. 8 is a detailed configuration diagram of a data pulse generator for generating data at the pixel shown in FIG. 7A and FIG. 7B.

FIG. 8 is a detailed configuration diagram of a data pulse generator for generating data at the pixel shown in FIG. 7A and FIG. 7B. Referring to FIG. 8, the data pulse generator includes multiplexors for selectively inputting the color data R, G and B via the timing controller 22, and D flip-flops 30, 31 and 32 receive control signals from the timing controller 22.

The multiplexors include a first multiplexor MUX1 for allowing the R data to be inputted upon driving of odd data while allowing the G data to be inputted upon driving of even data. A second multiplexor MUX2 allows the G data to be inputted upon driving of odd data while allowing the R data to be inputted upon driving of even data. A third multiplexor MUX3 allows the B data to be selectively inputted upon driving of odd and even data. A fourth multiplexor MUX4 connected to the third multiplexor MUX3 sends a control signal for controlling the third multiplexor MUX3. The fourth multiplexor MUX4 can be replaced with a tri-state buffer or a controlled switch.

The D flip-flops includes a serial connection of a first D flip-flop 30 and a second D flip-flop 31 for allowing an input dot clock Dclk to be outputted as a four-frequency-divided control pulse and a third D flip-flop 32 controlled by a horizontal synchronizing signal Hsync from the timing controller 22 for sending a control signal to the first, second and fourth multiplexors MUX1, MUX2 and MUX4. The dot clock Dclk from the timing controller 22 is input to the clock terminal CLK of the first D flip-flop 30. The output signal from the inversion output terminal Q' of the first D flip-flop 30 is input to the input terminal D thereof. The output signal from the non-inversion output terminal Q of the first D flip-flop 30 is input to the clock terminal CLK of the second D flip-flop 31. The output signal from the inversion output terminal Q' of the second D flip-flop 31 is input to the input terminal D thereof. The output signal from the non-inversion output terminal Q of the second D flip-flop 31 is input to the fourth multiplexor MUX4. When the dot clock Dclk is input from the timing controller 22, the first and second D flip-flops 30 and 31 connected in series allow a four-frequency-divided control pulse to be output from the non-inversion output terminal Q of the second D flip-flop 31. The four-frequency-divided control pulse has a frequency corresponding to ¼ of the dot clock Dclk. The four-frequency-divided control pulse output to the non-inversion terminal Q of the second D flip-flop 31 is input to the fourth multiplexor MUX4. A horizontal synchronizing signal Hsync from the timing controller 22 is input to the clock terminal CLK of the third flip-flop 32, and an output signal from the inversion output terminal Q' of the third D flip-flop 32 is input to the clock terminal CLK thereof. An output signal from the non-inversion output terminal Q of the third D flip-flop 32 is input to the first multiplexor MUX1, the second multiplexor MUX2 and the fourth multiplexor MUX4. When the horizontal synchronizing signal Hsync from the timing controller 22 is input to the third D flip-flop 32, the third D flip-flop 32 allows a two-frequency-divided control pulse to be inputted to the first, second and fourth multiplexors MUX1, MUX2 and MUX4. The two-frequency-divided control pulse corresponds to ½ of the dot clock Dclk in frequency.

The first multiplexor MUX1 receives the R and G data to selectively output the color signals in response to the control pulse from the third D flip-flop 32. The second multiplexor MUX2 receives the G and R data to selectively output the color signals in response to the control pulse from the third D flip-flop 32. The third multiplexor MUX3 receives the B data to selectively output the B color signal in response to a control signal from the fourth multiplexor MUX4 according to the control of the third D flip-flop 32. The control signal from the fourth multiplexor MUX4 includes the four-frequency-divided control pulse during any one of even and odd horizontal scanning periods. In other words, the control signal from the fourth multiplexor MUX4 includes the four-frequency-divided control pulse during the odd horizontal scanning period.

Figure 9A:
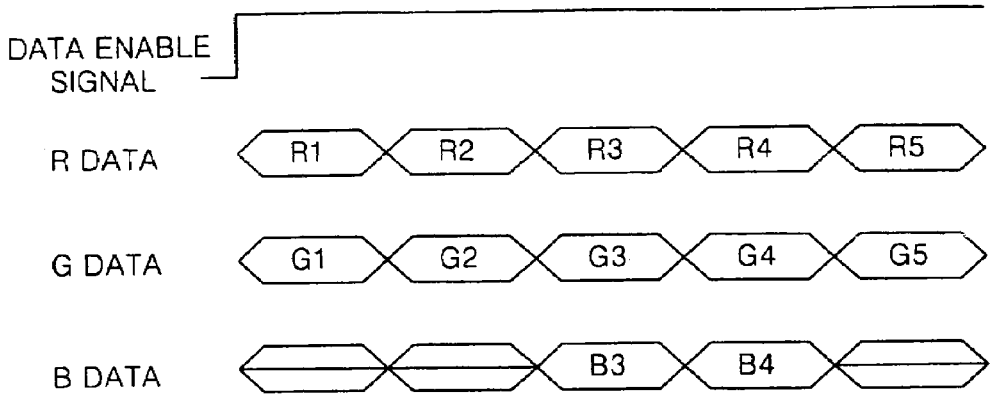
FIG. 9A and FIG. 9B illustrate output of odd and even color data to the data line by the driving apparatus shown in FIG. 8.
Figure 9B:
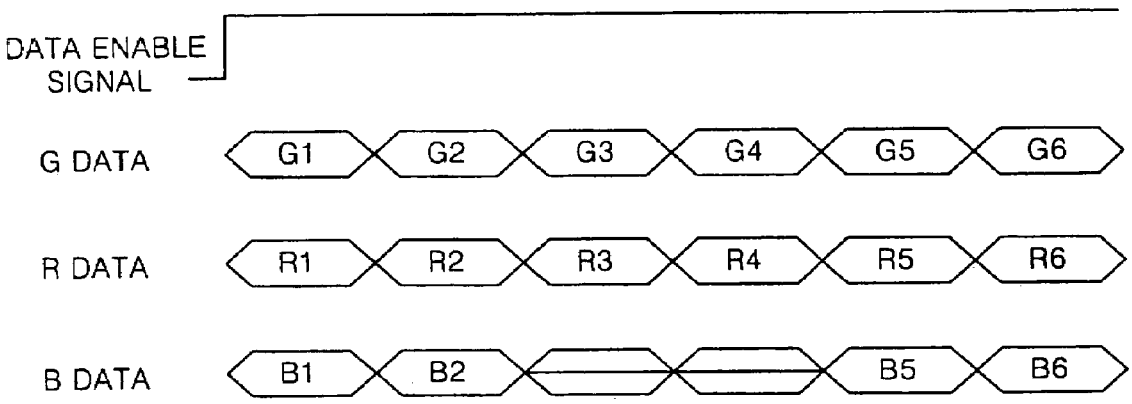

FIG. 9A and FIG. 9B illustrate output of odd and even color data into the data line by the driving apparatus shown in FIG. 8. Referring to FIG. 9A and FIG. 9B, the LCD driving method according to a first embodiment of the present invention alternately inputs the R data and the G data to an R data bus and a G data bus at every scan line so as to drive the liquid crystal display panel 26 having five color dots within one pixel. The B data signal is driven similar to the prior art, but it is input twice as shown in FIG. 9A and FIG. 9B when each of the R and G data is input four times due to the driving from the D flip-flop 32 as shown in FIG. 8 and the connections between the output terminal of the data driver 23 and the data line DL. In other words, if the R data signal is input first, then the third and fourth B data signals B3 and B4 are generated. On the other hand, if the G data signal is input first, then the first and second B data signals B1 and B2 are generated.

Figure 10A:
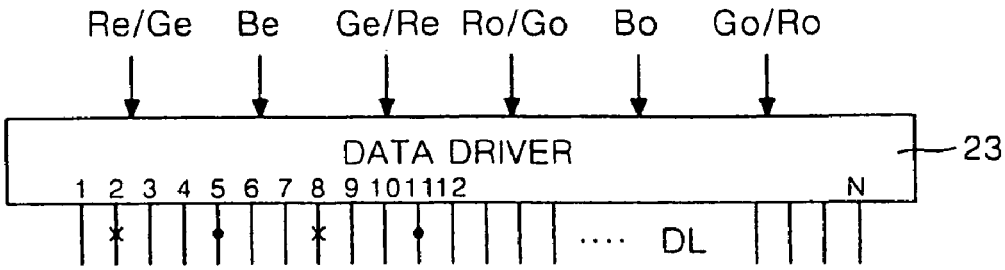
FIG. 10A and FIG. 10B illustrate a connection state of the data driver for driving the liquid crystal display panel having the pixel structure and the wiring shown in FIG. 6B.
Figure 10B:
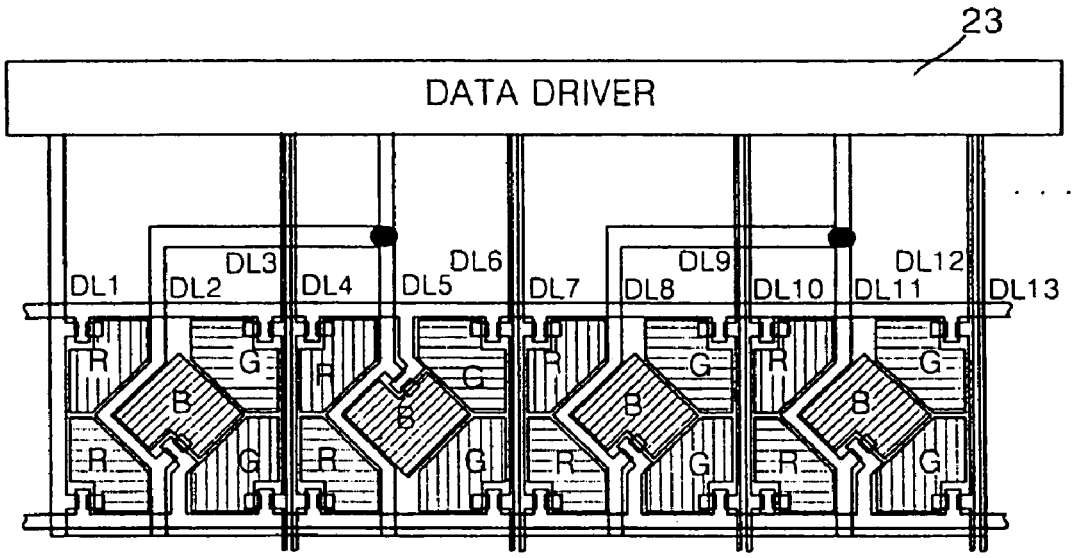

FIG. 10A and FIG. 10B illustrate a connection state of the data driver for driving the liquid crystal display panel having the pixel structure and the wiring shown in FIG. 6B. Referring to FIG. 10A and FIG. 10B, the LCD receives input signals Re, Ge, Ro, Go and Bo of the five bus system to output them to the 1st to nth data lines DL1 to DLn unlike that of FIG. 7A and FIG. 7B that receives input signals Re, Ge, Be, Ro, Go and Bo to be synchronized with a data clock.

In this embodiment, the 2nd and 8th output terminals of each of the 12 output terminals of the data driver 23 are broken or severed from the data lines DL. The 5th and 11th output terminals of the next-stage data driver 23 are normally connected to the data lines DL to output a B dot data. This connection manner is applied until the nth output terminal.

Figure 11:
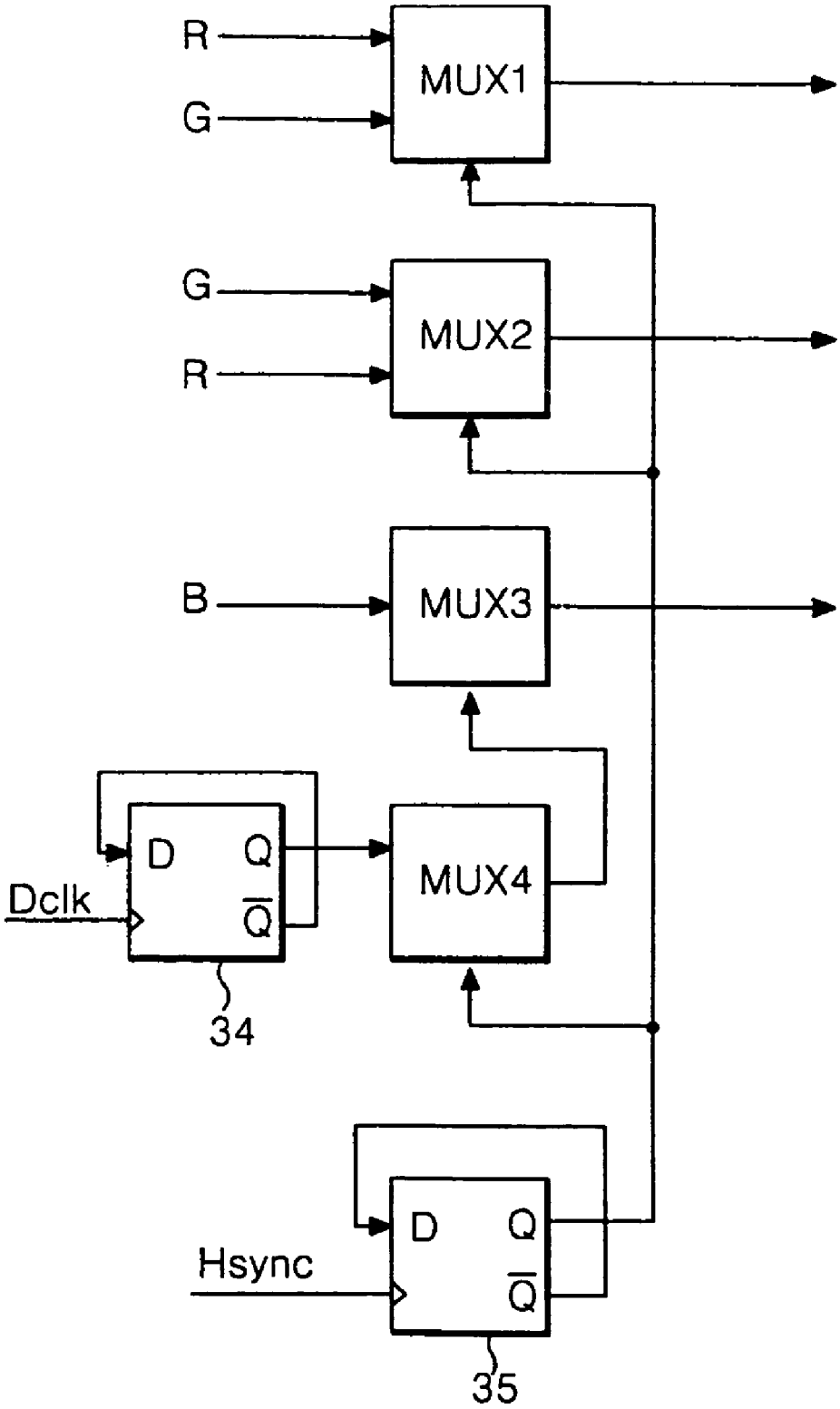
FIG. 11 is a detailed configuration diagram of a data pulse generator for generating data at the pixel shown in FIG. 10A and FIG. 10B.

FIG. 11 is a detailed diagram of a data pulse generator for generating data at the pixel shown in FIG. 10A and FIG. 10B. Referring to FIG. 11, the data pulse generator includes multiplexors for selectively inputting the color data R, G and B via the timing controller 22, and D flip-flops 33 and 34 for receiving control signals from the timing controller 22.

The multiplexors include a first multiplexor MUX1 for allowing the R data to be inputted upon driving of odd data while allowing the G data to be inputted upon driving of even data. A second multiplexor MUX2 allows the G data to be inputted upon driving of odd data while allowing the R data to be inputted upon driving of even data. A third multiplexor MUX3 allows the B data to be selectively inputted upon driving of odd and even data. A fourth multiplexor MUX4 connected to the third multiplexor MUX3 sends a control signal for controlling the third multiplexor MUX3.

The D flip-flops include a first D flip-flop 33 controlled by a dot clock Dclk from the timing controller 22 for sending a control signal to the fourth multiplexor MUX4, and a second D flip-flop 34 for allowing an input horizontal synchronizing signal Hsync to be outputted as a two-frequency-divided pulse. The dot clock Dclk from the timing controller 22 is inputted to the clock terminal CLK of the first D flip-flop 33. The output signal from the inversion output terminal Q' of the first D flip-flop 33 is input to the input terminal D thereof. The output signal from the non-inversion output terminal Q of the first D flip-flop 33 is input to the fourth multiplexor MUX4. A horizontal synchronizing signal Hsync from the timing controller 22 is input to the clock terminal CLK of the second D flip-flop 34, and an output signal from the inversion output terminal Q' of the second D flip-flop 34 is input to the input terminal D thereof. An output signal from the non-inversion output terminal Q of the second D flip-flop 34 is input to the fourth multiplexor MUX4, the first multiplexor MUX1 and the second multiplexor MUX2.

When the horizontal synchronizing signal Hsync is input from the timing controller 22, the second D flip-flop 34 allows a two-frequency-divided control pulse to be outputted to the non-inversion output terminal Q thereof. When the dot clock Dclk from the timing controller 22 is input to the first D flip-flop 33, the first D flip-flop 33 allows a two-frequency-divided control pulse to be input to the fourth multiplexor MUX4.

The first multiplexor MUX1 receives the R and G data to selectively output the color signals in response to a control signal from the second D flip-flop 34. The second multiplexor MUX2 receives the G and R data to selectively output the color signals in response to a control signal from the second D flip-flop 34. The third multiplexor MUX3 receives the B data to selectively output the B color signal in response to a control signal from the third multiplexor MUX4 according to the control of the second D flip-flop 34.

Figure 12A:
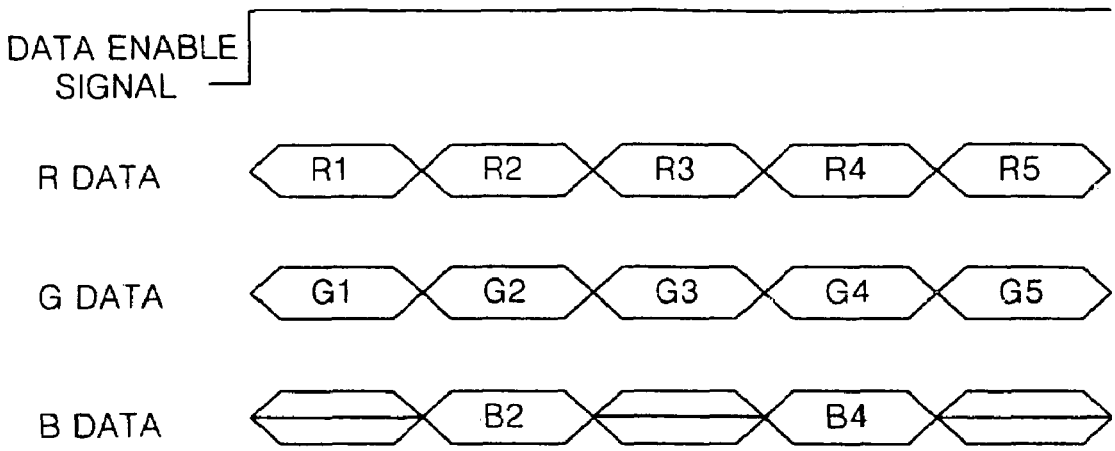
FIG. 12A and FIG. 12B illustrate output of odd and even color data into the data line by the driving apparatus shown in FIG. 11.
Figure 12B:
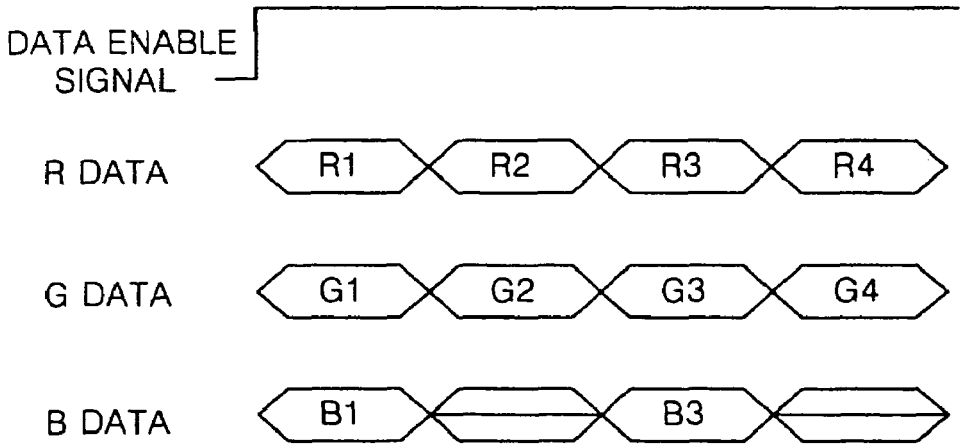

FIG. 12A and FIG. 12B illustrate applying an odd and even color data, via the data driver, to the data line by the driving apparatus shown in FIG. 11. Referring to FIG. 12A and FIG. 12B, the LCD driving method according to a second embodiment of the present invention alternately inputs the R data and the G data to an R data bus and a G data bus at every scan line so as to drive the liquid crystal display panel 26 having five color dots in a single pixel as shown in FIGS. 9A and 9B. The B data signal is driven similar to the prior art, but it is input twice, as shown in FIG. 12A and FIG. 12B when each of the R and G data is input four times due to the driving from the D flip-flops 33 and 34, as shown in FIG. 11 and the connections between the output terminals of the data driver 23 and the data line DL. In other words, if the R data signal is input first, then the second and fourth B data signals B2 and B4 are generated. On the other hand, if the G data signal is input first, then the first and third B data signals B1 and B3 are generated. The B data signal repeats the signal generation pattern as described above. Accordingly, if the R data signal is input first, then odd-numbered B data signals are generated. Otherwise, if the G data signal is input first, then even-numbered B data signals are generated.

FIG. 6A to FIG. 12B illustrate the case where the conventional data driver is used and a portion of the B data output terminals is broken or severed so as to drive the liquid crystal display panel including five color dots within one pixel.

In order to drive the liquid crystal display panel with such a pixel structure, a novel data driver may be used. More specifically, since the conventional data driver outputs 3 color dots, it has a three-time the number of output channels such as 384 channels. However, since the present driver breaks or severs one color dot (i.e., B color dot) output terminal in the course of generating 6 color dots, the output terminal of the data driver will do only five times the number of channels such as 320 channels. Accordingly, it becomes possible to drive the data driver having five times the number of channels for the purpose of driving the pixels.

Figure 13A:
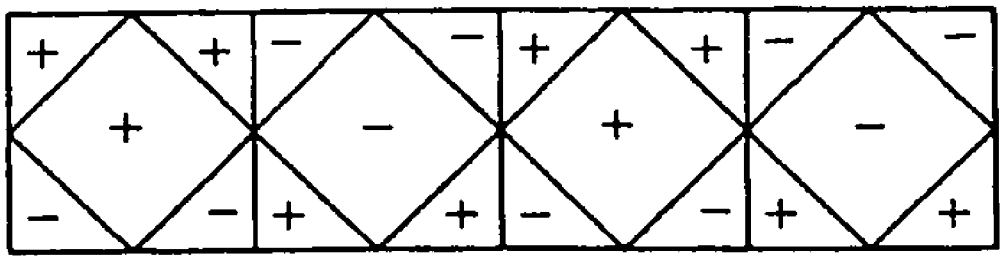
FIG. 13A and FIG. 13B depict polarity patterns of data signals applied to the pixels of the liquid crystal display panel by the driving method shown in FIG. 6A and FIG. 6B.
Figure 13B:
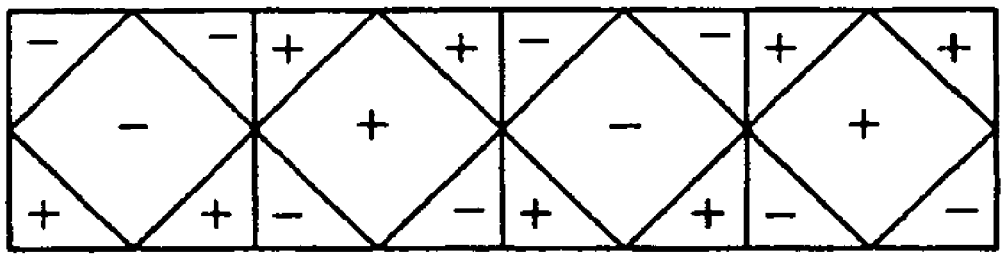

FIG. 13A and FIG. 13B depict polarity patterns of data signals applied to the pixels of the liquid crystal display panel by the driving method shown in FIG. 6A and FIG. 6B. Referring to FIG. 13A and FIG. 13B, the pixels are arranged in a matrix type such that each lozenge is in internal contact with each regular square.

In the first pixel of FIG. 13A, the upper left and upper right edges around the middle lozenge-shaped B data have a positive(+) polarity while the lower left and lower right edges have a negative(−) polarity. At this time, the middle B data has a positive(+) polarity. In the second pixel, the upper left and upper right edges around the middle lozenge-shaped B data have a negative(−) polarity while the lower left and lower right edges have a positive(+) polarity. At this time, the middle B data has a negative(−) polarity. In the third pixel, the upper left and upper right edges around the middle lozenge-shaped B data have a positive(+) polarity while the lower left and lower right edges have a negative(−) polarity. At this time, the middle B data has a positive(+) polarity. In the fourth pixel, the upper left and upper right edges around the middle lozenge-shaped B data have a negative(−) polarity while the lower left and lower right edges have a positive(+) polarity. At this time, the middle B data has a negative(−) polarity.

On the other hand, in the first pixel of FIG. 13B, the upper left and upper right edges around the middle lozenge-shaped B data have a negative(−) polarity while the lower left and lower right edges have a positive(+) polarity. At this time, the middle B data has a negative(−) polarity. In the second pixel, the upper left and upper right edges around the middle lozenge-shaped B data have a positive(+) polarity while the lower left and lower right edges have a negative(−) polarity. At this time, the middle B data has a positive(+) polarity. In the third pixel, the upper left and upper right edges around the middle lozenge-shaped B data have a negative(−) polarity while the lower left and lower right edges have a positive(+) polarity. At this time, the middle B data has a negative(−) polarity. In the fourth pixel, the upper left and upper right edges around the middle lozenge-shaped B data have a positive(+) polarity while the lower left and lower right edges have a negative(−) polarity. At this time, the middle B data has a positive(+) polarity.

The data signals applied to the pixels of the present liquid crystal display panel alternately repeat the polarity pattern as shown in FIG. 13A and FIG. 13B in this manner, and have a voltage charge polarity for each dot over the entire panel.

As described above, according to the present invention, a connection relationship between the output terminals of the data driver and the data lines is different from the prior art and a novel data driver having a different number of output terminals is used so as to drive the liquid crystal display panel having five color dots within one pixel, thereby driving the liquid crystal display panel of a dot inversion system as well as reducing flicker.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

a first pixel having first, second, third, fourth and fifth dot components, each of the first, second, third, fourth and fifth dot components having a switching element;

a second pixel having sixth, seventh, eighth, ninth and tenth dot components, each of the sixth, seventh, eighth, ninth and tenth dot components having a switch element;

a data driver and a gate driver;

a plurality of data lines connected to the data driver and respective switching elements;

a plurality of gate lines connected to the gate driver and the respective switching elements;

wherein the first and second dot components are connected to a first data line, the third dot component is connected to a second data line, and the fourth and fifth dot components are connected to a third data line, wherein the sixth and seventh dot components are connected to a fourth data line, the eighth dot component is connected to a fifth data line, and the ninth and tenth dot components are connected to a sixth data line, wherein the third dot component of the first pixel is connected to the eighth dot component of the second pixel, wherein a first output line of the data driver is connected to first and second dot components, a second consecutive line of the data driver is disconnected from any dot components, a third consecutive line of the data driver is connected to fourth and fifth dot components, fourth consecutive line of the data driver is connected to the sixth and seventh dot components, fifth consecutive line of the data driver is connected to the eighth dot component, sixth consecutive line of the data driver is connected to the ninth and tenth dot components.

* * * * *